United States Patent [19]

Johansson et al.

[11] Patent Number: 4,937,978

[45] Date of Patent: Jul. 3, 1990

[54] JOINING OF SIDE-PLATES AT A METAL DOOR

[75] Inventors: Arne Johansson; Inga-Lisa Johansson, both of Töreboda, Sweden

[73] Assignee: Daloc AB, Toreboda, Sweden

[21] Appl. No.: 353,655

[22] PCT Filed: Nov. 24, 1987

[86] PCT No.: PCT/SE87/00557

§ 371 Date: May 3, 1989

§ 102(e) Date: May 3, 1989

[87] PCT Pub. No.: WO88/03983

PCT Pub. Date: Jun. 2, 1988

[30] Foreign Application Priority Data

Nov. 24, 1986 [SE] Sweden ..... 8605025

[51] Int. Cl.[5] ..... E05D 7/00

[52] U.S. Cl. ..... 49/399; 49/367; 49/501; 52/805

[58] Field of Search ..... 49/501, 399, 367, 369; 52/805, 804, 803

[56] References Cited

U.S. PATENT DOCUMENTS

| | | | |
|---|---|---|---|
| 445,262 | 1/1891 | Kinnear | 52/805 |
| 1,848,715 | 3/1932 | Hart et al. | 52/805 |
| 2,912,725 | 11/1959 | Ries | 52/803 X |
| 3,386,209 | 6/1968 | Starcevic | 49/501 |
| 3,750,333 | 8/1973 | Vance | 49/501 |
| 4,087,942 | 5/1978 | Herrmann | 49/501 |
| 4,397,116 | 8/1983 | Habicht et al. | 49/501 |
| 4,429,493 | 2/1984 | St. Aubin | 49/367 |

*Primary Examiner*—Philip C. Kannan

*Attorney, Agent, or Firm*—Sughrue, Mion, Zinn, Macpeak & Seas

[57] ABSTRACT

A metal door construction has two sheet-metal panels 10,11 which form the flat sides of the door. The panels present folded side-edge portions 10*a*–10*g*, 11*a*–11*e* which extend parallel to and in contact with one another within a joint region 10*f*; 11*e*. One panel is provided with a double fold 10*c*, 10*e* which forms a pocket for receiving the straight end-edge part 11*f* of the other panel. The other panel is provided with an outwardly folded profiled part, in the form of a bead or like promontory 11*b*, on the other side of the joint region. The metal door may be provided with a mullion structure for cooperation with a similar metal door 3 to form a double door construction hung in the same frame. The mullion structure includes a plate 4 which covers a hooked latching bolt used to hold the two doors together and to prevent the door crack from increasing to a non-permitted extent in the event of fire.

6 Claims, 3 Drawing Sheets

JOINING OF SIDE-PLATES AT A METAL DOOR

FIELD OF THE INVENTION

The present invention relates to metal door structures of the kind in which the door leaf comprises two metal panels which extend in mutually parallel spaced relationship and which perferably incorporate therebetween an intermediate filling of insulating material; and which form the planar sides of the door leaf and each of which metal panels presents folded side-edge portions which in the vicinity of a joint region in which the two panels are joined together extend parallel with and in contact with one another, wherewith one panel presents on one side of the joint region a double fold which forms a pocker in which part of the other pane is received.

BACKGROUND PRIOR ART

Such metal doors are known to the art and are primarily intended for use as fire doors. Thus, there is described in FI, C,49 457 a fire door in which two mutually opposing planar panels are provided with resilient coupling members which extend along respective panels and which are intended to be snapped into one another, by displacing the one panel relative to the other. A similar snap-coupling arrangement is described in AT,B,381 767.

SE,A,8103482-9 describes a similar arrangement, in which the coupling members are formed by folding the outer ends of respective panels of the door leaf.

These known fire doors are made of steel and are relatively complicated in manufacture, particularly when desiring to vary the thickness of such doors. The aesthetic appearance of such doors is also impaired by at least one of the joints located along the side edges of the door, and hence doors of this known construction cannot be used in rooms where the door shall have a fully aesthetic appearance.

It is also impossible to use such door constructions readily in conjunction with double doors, in which the door leaf of one of the doors carries a mullion which cooperates with the other door leaf of the other door.

Further examples of doors constructed in accordance with prior art techniques are described in SE,C, 167, 656, DE,C1 3 423 550 and FR,A2,2 400 608. SE,C, One object of the present invention is to provide a metal door construction which avoids the aforesaid drawbacks and other drawbacks encountered with known metal doors and fire doors, while simplifying the manufacture of such doors and enhancing the flexibility thereof, and which will satisfy all requirements with regard to aesthetic appearance.

SUMMARY OF THE INVENTION

These and other objects are fulfilled by the invention door construction which is of the aforesaid kind and which is mainly characterized in that said pocket is intended to receive a straight end-edge part of the other sheet metal panel which extends out of the pocket and along said joint region.

With doors constructed in accordance with the invention the panel edges are hidden, thereby rendering the door leaf more aesthetic. Shaped metal plate and steel plate which is surface treated, e.g. hot-galvanized steel plate, or steel plate coated with polyvinyl chloride can be used without risk of corrosion or mechanical damage, e.g. as a result of the occurrence of sharp edges when shearing the steel plate. Furthermore, it can be ensured readily that no cold bridges will be incorporated between the metal panels during the process of manufacture.

The panel which is provided with the double fold forms a basic profile which can be used for all occurrent types of door and which is independent of whether the door is a right-hung or a left-hung door. It is also simple to vary the thickness of the door, by varying the width of that part of the second panel which is received in the pocket. By making only minor modifications, the door can be used both as a square edge door and as a rebated door.

In practice it is preferred that the other or second panel is provided on the other side of the joint region with a folded profile in the form of a bead, such that the side edge of the door is provided with a channel or a groove between the double fold and the bead. This channel can be used to hold a decoration strip, preferably of a different colour to that of the door and/or made of a different material. This facility enhances standardization in manufacture, which particularly facilitates the manufacture of doors from ready painted steel plate or steel plate that is coated with polyvinyl chloride (PVC). At the same time, it is readily simple to adapt the appearance of the door to those requirements placed on different environments in which the door may be used.

The inventive door construction also facilitates the attachment of door hinges, particularly if in accordance with one preferred embodiment of the invention the blade part of the hinge is passed through the bead and extends in the joint region adjacent the second panel and is connected thereto, preferably with the aid of screws. In addition to facilitating attachment of the door to the hinges, the inventive door construction enables the hinges to be substantially hidden from view.

A metal door, or fire door, of the kind described is normally provided on the inside of the joint region with an edge reinforcing plate which extends between the planar door panels and which supports the two folded plates in the joint region and is connected to at least the inner surfaces of said plates.

A particular advantage is afforded in accordance with the invention when the edge reinforcing plate on the side of the joint region opposite said double fold has an obliquely and inwardly extending part and when the end edge of the first plate or panel provided with the double fold has a correspondingly folded part such that the end-edge part will abut the inwardly directed part of the edge reinforcing plate.

In addition to the door stiffening effect afforded by the edge reinforcing plate, assembly of one panel plate to the other is also facilitated thereby, since the fold at the end edge of the panel plate provided with the double fold assists in guiding the other panel, when fitting the panel into the pocket.

In the case of double doors the steel doors are normally joined through the medium of a mullion or frame structure intended to cooperate with respective door leaves of the double doors.

In accordance with the present invention it is preferred that this mullion includes a metal plate which on the side of the mullion which is turned towards the side edge of the metal door carrying said mullion extends away from the region of the double fold at least partially around the mullion, along its remaining side surfaces and back to the first mentioned mullion side surfaces, and in that the plate is provided on a side surface of the mullion adjacent said side edge with a folded part which forms two mutually adjacent legs which extend parallel with the other metal door to form an abutment edge or a rebate therefor.

In this case, the mullion plate suitably has a similarly folded part which present two mutually adjacent legs which extend parallel with the first metal door to which the mullion is secured. Such a mullion plate will improve the aesthetic appearance of the door, since it hides those structural members used for joining together the door components. This door characteristic is of particular value in those cases where the mullion structure accommodates a fire door latch arrangement in the form of a hooked latch bolt provided with a folded end part which, in the closed position of the doors, engages the other metal door in a manner to ensure that the distance between the two doors will not increase in the event of a fire. The folded leg portions of the metal mullion structure will, in this case, cover the hooked latch bolt, so as to hide the bolt from view.

It will therefore be understood that the inventive door structure affords reliable protection against fire even in the case of a door which is required to have an aesthetic appearance.

The two metal plate door panels may be joined permanently together, by means of one or more welding joints in the joint region of said panels and the edge reinforcing plate. Alternatively, the two metal door panels may be jointed together by riveting or by glueing.

Those parts of the mullion structure which are visible from the room served by the door may be formed from steel plate which has been hot galvanized, coated with PVC or lacquered, or may be formed from some other metal plate, optionally metal plate corresponding to the door leaves. The hooked latch bolt covered by the metal-plate mullion structure is primarily intented to prevent the crack between the mutually adjacent door leaves from increasing in the event of fire. The hooked latch bolt will also serve, however, to hold the lock bolt of the door in locking engagement.

Further characteristic features of a steel door structure according to the invention will be apparent from the following description, which is made with reference to preferred embodiments of the inventive door structure and with reference to the accompanying drawings.

A DESCRIPTION OF PREFERRED EMBODIMENTS

Figure 1:
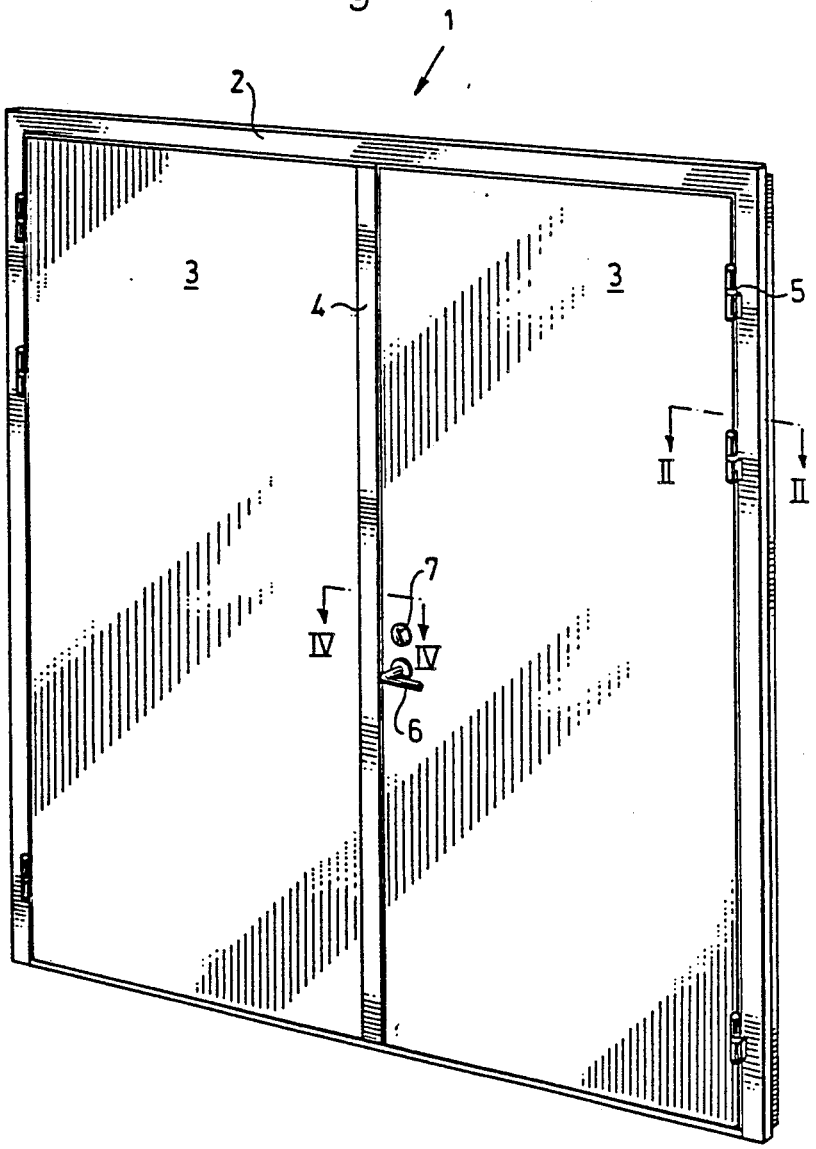
FIG. 1 is a perspective view of a door frame in which a double door structure constructed in accordance with the invention is hung.

FIG. 1 illustrates a metal double-door construction which comprises a metal door frame 2 in which two door leaves 3 are hung. One door leaf carries a so-called mullion structure 4. The door leaves are hung on hinges 5, and one of the doors 3 is provided with a door handle 6 and a lock mechanism 7. The mullion structure 4 is attached solely to the door leaf 3 which lacks the door handle and the lock mechanism.

Figure 2:
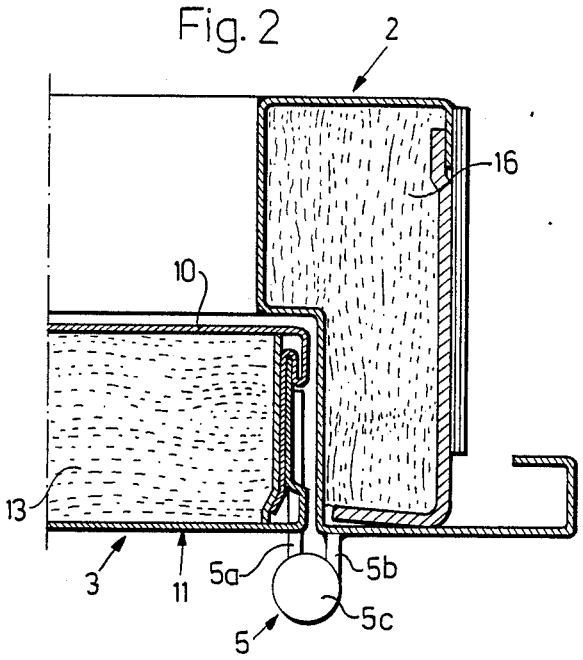
FIG. 2 is a horizontal sectional view taken on the line II—II in FIG. 1.
Figure 3:
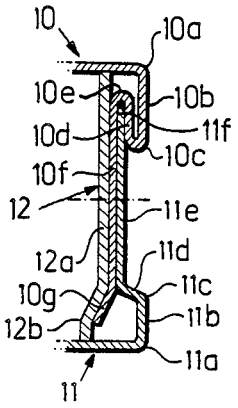
FIG. 3 illustrates in larger scale part of the door structure illustrated in FIG. 2.

With particular reference to FIGS. 2 and 3, it will be seen that each door leaf 3 comprises two metal panels 10, 11 which extend in mutually parallel spaced relationship and which accommodate therebetween an intermediate filling of insulating material 13. The panels are provided with folded side-edge portions which extend parallel to and in contact with each other within a joint region 10*f*, 11*e* in which the panels are jointed together. This establishes broken cold bridges, i.e. thermal conduction paths, between the panels.

One end of the planar metal panel 10 is folded through 90° at 10*a* to form a section which extends along one side edge of the door.

This side edge section of the panel is also folded on one side of the joint region in a manner to form a double fold 10*c*, 10*e* having an intermediate section 10*d*, such as to form a pocket which receives the straight end-edge part 11*f* of the other metal panel 11. This latter, second metal panel 11 is provided on the other side of the joint region 10*f*, 11*e* with a folded profile part in the form of a bead 11*b*. Thus, there is formed between the 180°-bend 10*c* of the first panel and the bead 11*b* a channel or recess in which there can be fitted a decorative strip 17 (see FIG. 4) of some suitable material and/or of suitable colour.

Each of the hinges 5 has a blade part 5*a* which is inserted through a slot in the panel 11, adjacent its 90°-bend 11*a*, and into a slot provided in the bead part 11*b*. The blade part 5*a* of respective hinges then extends into the joint region between the two panels, and is secured to at least the outer panel, i.e. the second panel 11, with the aid of screws, rivets or welds (not shown in FIGS. 2 and 3).

The metal door structure also includes on the inside of the joint region an edge reinforcing plate 12 which extends between the two planar panels of the door. This plate 12 supports the two folded plates in the joint region and is secured to the inner panel along the joint region 10*f*, for instance by welding, riveting or glueing.

One end of the edge reinforcing plate 12 has an obliquely and inwardly extending part 12*b*. The end edge 10*g* of the first panel has a corresponding end, so as to abut said inwardly directed part 12*b* of the edge reinforcing plate 12. This arrangement facilitates assembly of the two components in conjunction with a panel joining operation.

Figure 4:
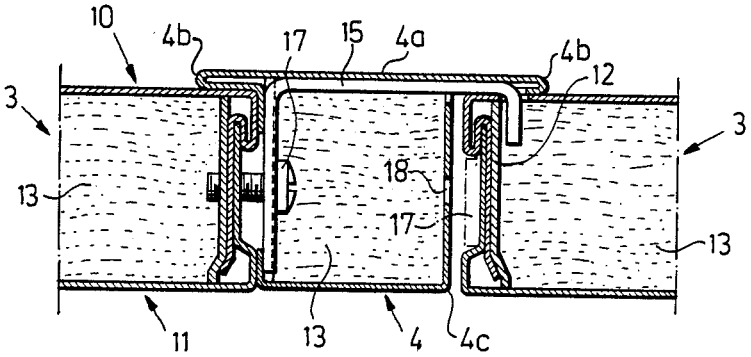
FIG. 4 is a horizontal sectional view taken on the line IV—IV in FIG. 1.

FIG. 4 illustrates a metal door 3 to which there is attached a mullion structure 4 intended for cooperation with a similar metal door 3, to form a double door construction.

The mullion can be said to have a generaly rectangular or square configuration, although the mullion structure of the illustrated embodiment has on each side of a central part 4*a* a folded part 4*b* which includes two mutually parallel legs. These parts project on each side parallel with the planar panels of the metal doors. The mullion structure 4 thus covers the regions of the side edges at which the panels are connected, so as to hide the joint regions from view.

Figure 5:
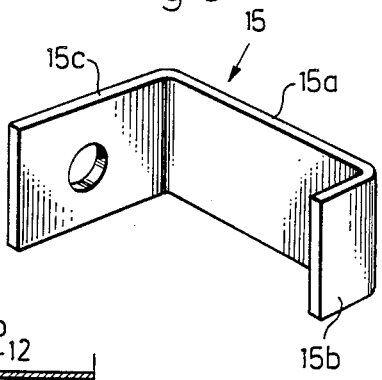
FIG. 5 is a perspective view of the hooked latch bolt illustrated, inter alia, in FIG. 4.

A hooked latch bolt 15 (see FIGS. 4 and 5) is secured to the mullion structure by means of a screw 19 and has a folded part 15*b* engaged in a recess in the adjacent door leaf 3. The hooked latch bolt ensures that the crack between the door leaves 3 will not increase in the event of fire and that the lock bolt of the lock mechanism is held in engagement with the opposite door.

The folded leg parts 4*b* of the mullion structure 4 cover the hooked latch bolt, so that it cannot be seen.

The panels 10, 11 may be made of mutually different metal and may have mutually different surface coatings, and may comprise, e.g. hot galvanized steel plate or steel plate that is coated with polyvinyl chloride. The reference 18 identifies a hole for securing the mullion structure with the aid of a screw 19.

The mullion structure 4 may also be made of hot galvanized steel plate or steel plate which is coated with polyvinyl chloride or, optionally similar to the door leaves, may comprise ready lacquered steel plate, or some other metal plate. The insulation 13 provided in the doors and mullion structure ensures that no cold bridges are formed.

The door frame 2, including the frame part 5*b* in which the hinges are fitted, may also be provided with insulation, as shown at 16.

Figure 6:
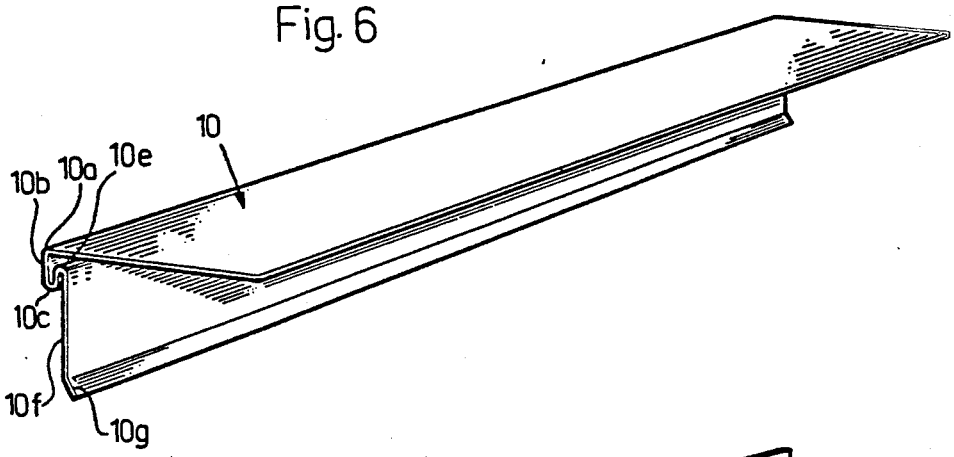
FIG. 6 is a perspective view of a suitable profile shape of the first metal panel.

FIG. 6 is a perspective view which illustrates a suitable profile shape for the first door panel 10. This panel embodiment also includes a shoulder-like abutment 10*g*.

Figure 7:
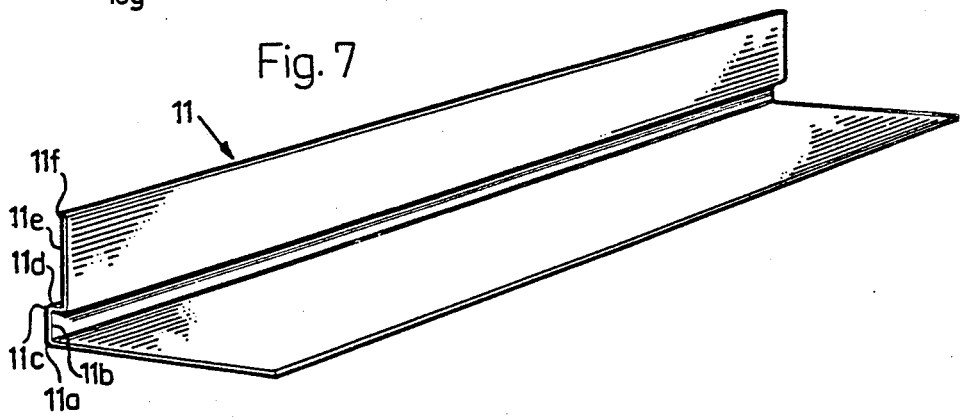
FIGS. 7 and 8 are perspective views which illustrates various alternative profile shapes of the second metal panel.
Figure 8:
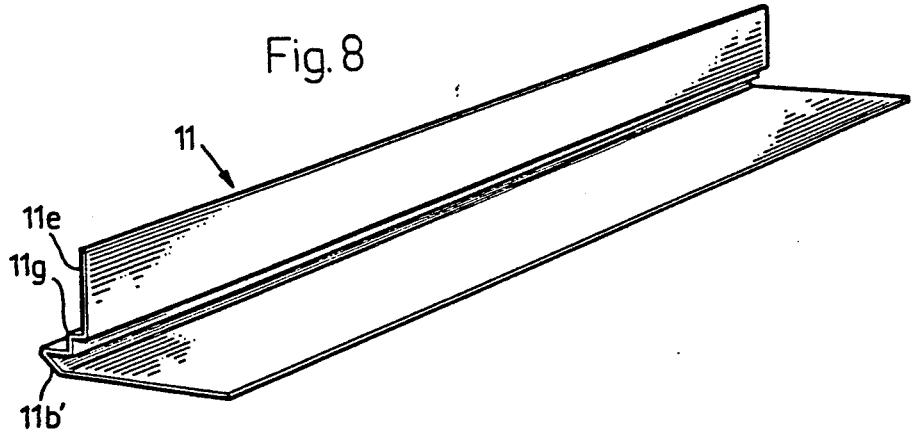

FIGS. 7 and 8 illustrate respectively alternative profile shapes of the second door panel 11. The Figures also illustrate various usable forms of bead 11*b* and 11*b*'.

The thickness of the door leaves can be varied readily, by varying the width of the edge part 11*e* of the second door panel.

We claim:

1. A metal door construction which comprises two sheet-metal panels (10, 11) which extend in mutually parallel, spaced relationship, preferably with an intermediate filling of insulating material (13), to form planar sides of a door leaf, and which present folded side-edge portions (10*a*–10*g*; 11*a*–11*f*) which extend parallel to and in contact with each other within a joint region (10*f*, 11*e*) in which the leaf panels are connected together; and in which a first one of the leaf panels (10) is provided on one side of the joint region (10*f*; 11*e*) with a double fold (10*c*, 10*e*) which forms a pocket for receiving a part of a second one of the leaf panels, wherein: (a) a straight end-edge portion (11*f*) of the second leaf panel (11) is received in said pocket and extends therefrom along the joint region (10*f*; 11*e*), (b) said second leaf panel is provided on another side of the joint region with a folded profile part in the form of a bead or like promontory (11*b*), therewith to form a channel or recess in a side-edge surface of the door between the double fold and the bead, (c) the door is hung in a steel frame (2) by means of hinges (5) which comprise a blade part (5*a*) and a frame part (5*b*), and (d) the hinge blade part (5*a*) is passed through the bead and into the joint region, extends adjacent to said second leaf panel, and is preferably secured to said second leaf panel with the aid of screws.

2. A door construction according to claim 1, characterized by a decoration strip (17) fitted in said channel or recess and preferably having a colour and/or being made of a material which deviates from the door colour and/or door material.

3. A door construction according to claim 1 in which the metal door is provided on an inward side of the joint region with an edge-reinforcing plate (12) which extends between the planar sides and which supports the two folded leaf panels (10, 11) in the joint region and is secured to at least the first panel (10), characterized in that the edge reinforcing plate presents an obliquely inward extending part (12*b*) on the side of the joint region (10*f*; 11*e*) opposite the double fold (10*c*, 10*e*); and in that said first panel provided with the double fold presents at its end edge (10*g*) a corresponding bend, such that said end-edge portion (10*g*) abuts the inwardly directed part (12*b*).

4. A door construction according to claim 1, in which the metal door is provided with a mullion structure (4) which is intended to co-act with a similar, adjacent metal door (3) to form a double door construction hung in one and the same door frame, characterized in that the mullion structure includes a metal plate which on one side of said mullion structure is turned towards a side edge of the mullion supporting door distal from the region of the double fold (10*c*, 10*e*) and extends at least partially around the mullion structure, along its remaining side edges and back to the first mentioned side of said mullion structure; and in that the metal plate is provided on the side of the mullion structure lying adjacent said side edge with a folded part (4*b*) which forms two mutually adjacent legs which extend parallel with the adjacent metal door, to form a door abutment surface or a door rebate frame.

5. A door construction according to claim 4, characterized in that the mullion plate presents a further part (4*b*) which is folded in a similar fashion to the first mentioned folded part (4*b*) and which similarly presents two mutually adjacent legs which extend parallel with the metal door to which the mullion structure is secured.

6. A door construction according to claim 4 or 5 in which the mullion structure includes a fire latching device in the form of a hooked latching bolt (15) having a folded end part (15*b*) which in the closed position of the two doors of the double door structure engages in said adjacent metal door in a manner to ensure that the distance between the mutually facing edge surfaces of the two doors will not increase to an unpermitted extent in the event of fire, characterized in that the mullion plate covers the hooked latching bolt to hide said bolt from view.

* * * * *